United States Patent [19]

Holman

[11] Patent Number: 4,867,017

[45] Date of Patent: Sep. 19, 1989

[54] FUNNEL TOOL TO REMOVE OIL FILTERS

[76] Inventor: Mark A. Holman, 1006 W. Waterloo Rd., Arkon, Ohio 44314

[21] Appl. No.: 166,428

[22] Filed: Mar. 10, 1988

[51] Int. Cl.[4] ..... B25B 13/06

[52] U.S. Cl. ..... 81/121.1; 7/100; 81/120

[58] Field of Search ..... 81/3.09, 3.4, 121.1, 81/124.4, 124.7, 120; 137/320, 577, 579, 615; 184/1.5, 105.1

[56] References Cited

U.S. PATENT DOCUMENTS

| | | | |
|---|---|---|---|
| 1,954,422 | 4/1934 | McIntyre | 81/120 UX |
| 2,746,330 | 5/1956 | Pfetzing | 81/124.7 |
| 2,987,080 | 6/1961 | Chandler et al. | 81/124.2 X |
| 3,385,141 | 5/1968 | Norman | 81/120 |
| 3,837,242 | 9/1974 | Harper | 81/3.09 |
| 4,230,002 | 10/1980 | Skidmore | 81/124.7 |
| 4,697,480 | 10/1987 | Robideau | 81/3.4 X |
| 4,714,138 | 12/1987 | Zaccone | 81/121.1 X |

*Primary Examiner*—James G. Smith
*Attorney, Agent, or Firm*—Oldham & Oldham Co.

[57] ABSTRACT

A tool for use when changing the oil filter of an engine and refilling or putting oil into the engine. The tool is generally funnel shaped, having an internal surface which frictionally engages the oil filter after its seal has been broken. The tool has an extended portion of a greater diameter than the filter to catch any oil which escapes as the filter is removed. The escaping oil is channeled to the outlet portion of the funnel, to which a plastic tubing may be positioned to remove the escaping oil. The tool may then be used as a funnel to fill the engine and complete the oil changing process.

11 Claims, 2 Drawing Sheets

FUNNEL TOOL TO REMOVE OIL FILTERS

BACKGROUND OF THE INVENTION

The present invention relates to a special purpose tool for the removal of canister type oil filters from engines and, more specifically, to a tool which enables removal of oil filters without spillage therefrom, and which then can be used to refill the engine with oil.

Conventional canister type oil filters are normally placed on the bottoms of internal combustion engines where there is little access resulting in a very messy procedure of removal. Generally, the mechanic must loosen the seal on the filter with a single purpose wrench, and subsequently unscrew the filter by hand thereby resulting in hot oil within the filter spilling over and down the sides of the filter. In this way, the oil that spills over the sides of the filter gets on to the mechanic making the procedure both undesirable due to the resulting mess and potentially hazardous as the oil may burn the mechanic.

There have been known, tools which facilitate the removal of oil filters without creating a mess as in the general method. One such tool is shown in U.S. Pat. No. 4,177,529, issued to Sikula, Jr., which shows a filter wrench which is placed around the oil filter and used to puncture the filter and drain the oil therefrom. In this invention, the tool is used to drain the oil from the filter before the filter is removed from the engine, and thereby prevent any spillage. It is seen that this procedure has drawbacks in that a substantial length of time must be provided for the filter to drain, and the spillage may still occur when the oil is removed from the tool itself.

Another tool which is known in the art is shown by U.S. Pat. No. 4,266,452, issued to Christ, which shows an oil filter wrench comprising a special configuration related to the external configuration of a certain canister type oil filter. The tool forms a polygonal socket which engages the end of the filter canister, and also has a reservoir for oil which leaks from the filter canister. Such a tool cannot be generally used with all oil filter configurations, and again spillage may occur when the oil is to be removed from the reservoir provided in the tool.

There has been a long-felt need for a tool which would be both convenient to use while providing clean removal of oil filters, and which overcomes the deficiencies of the prior art. There has also been a need for providing a tool which can subsequently be used to refill the internal combustion engine with oil to complete the oil changing process.

SUMMARY OF THE INVENTION

In the present invention, a tool is provided which may be conveniently used to provide clean removal of canister type oil filters, and which may subsequently be used to refill the engine with oil. A housing is provided which may be conveniently and economically fabricated from molded plastic or the like, and has dimensions related to generally used oil filters. The housing has a funnel-like shape, in which a major portion thereof is adapted to frictionally engage the oil filter. The open end of the tool has a diameter somewhat larger than that of the oil filter, and thereafter is provided with a filter engaging section in which a substantial portion of the oil filter is inserted into the tool. The lower portion of the tool comprises an outlet passage, wherein any oil spilling from the engine or the filter and into the housing is thereby drained through the outlet passage. The lower portion of the tool is adapted to engage a length of plastic tubing which may be used to drain the oil to a desired location away from the immediate area.

It is a principal object of the present invention to provide a tool for the removal of canister type oil filters, which has an extended portion of a greater diameter than the filter to catch any oil which escapes when the filter is removed.

Another object of the present invention, is to provide a tool for removing canister type oil filters which is adapted to engage different sized filters, and may be generally used with many sizes or brands of oil filters.

It is a further object of the present invention to provide a tool which may be used to remove canister type oil filters, and thereafter be used to refill the engine with oil and complete the oil changing procedure.

The above and additional advantages of the present invention will become apparent to those skilled in the art from reference to the detailed description of the invention taken in conjunction with the accompanying drawings.

BRIEF DESCRIPTION OF THE DRAWINGS

The invention will now be described further by way of example with reference to the accompanying drawings, in which.

DETAILED DESCRIPTION OF THE INVENTION

Figure 1:
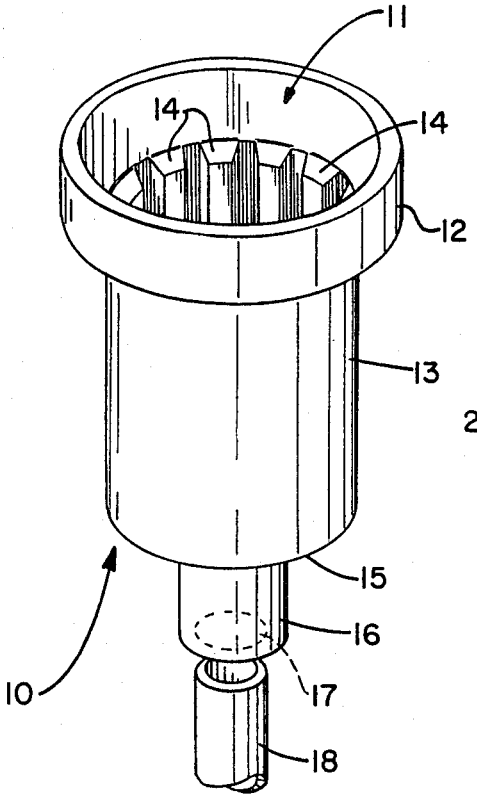
FIG. 1 is a perspective cutaway view taken through the center of the tool of the present invention.

Referring now to the drawings, in FIG. 1 is shown the tool of the present invention for cleanly removing canister filters, and refilling the engine with oil. The tool, designated generally by reference numeral 10, comprises a housing having a funnel-like shape with an open top end 11 for insertion of the canister filter. The uppermost section 12, has a greater diameter than that of the filter thereby insuring that any spillage of oil from the filter during removal is caught by and channelled through the tool of the present invention. A reduced diameter portion, 13 is of such a size as to accommodate various sized canister filters that are generally used in the automotive and similar industries on internal combustion engines. A portion of the tool 13 also comprises projections on the inside thereof, which form a smaller diameter surface which frictionally engages the filter to facilitate removal. The housing 10 along with projections 14 are conveniently and economically fabricated from molded plastic or similar material which is of a nature to withstand the relatively high temperatures at which the oil may be found. The projections 14 being comprised of a plastic or similar material, have a resilient characteristic which facilitates proper frictional engagement with the filter, and may accommodate different sized filters. The portion 13 of the tool may be tapered from the upper end to further facilitate adaption of the tool to different sized filters.

When the tool of the present invention is placed around a canister type filter, the upper portion 12 and portion 13 of the tool facilitate placement of a substantial portion of the filter within the tool for improved retention of any escaping fluid from the filter, and to facilitate easy turning and removal of the filter. If the canister type filter is simply hand tightened onto the engine, the tool of the present invention may be used to break the seal of the filter with the engine, although normally the seal may be broken with a conventional oil filter wrench. When a conventional oil filter wrench is used to break the seal with the engine, no leakage occurs immediately after the seal is broken and the mechanic may then place the tool of the present invention around the filter for removal.

During removal of the filter, any escaping oil is caught and channelled by the larger diameter portion 12 and down to a main body portion of reduced diameter section 13 in between the projections 14. Below the filter within the tool is provided a reservoir 15 which is a further reduced diameter portion and enables the tool to accommodate any amount of oil which may be encountered.

At the bottom of the tool, is provided an outlet portion 16 to which the escaping oil is channelled and may be drained to an appropriate container and disposed of. The outlet portion of 16 of the tool is adapted to be engaged by a length of plastic tubing 18 for cleanly and efficiently removing any escaped fluid from the immediate area and into an appropriate container. By providing reservoir 15 with outlet opening 17, which is of sufficient diameter to accommodate significant amount of oil, the tool of the present invention will easily handle any amount of spilled fluids which reasonably can be expected. The construction of the tool will facilitate channelling of any spilled fluids around the filter to the outlet opening 17, wherein the fluids will enter the plastic tubing 18 and be drawn away from the area.

It can easily be seen that the tool of the present invention may also be used to refill or simply add oil to the internal combustion engine. Again, such a procedure is often very messy and can result in oil being spilled on the engine. With the tool of the present invention, the outlet portion 16 of the tool may be placed directly into the filling inlet of the engine, or alternately may be used with a length of plastic tubing 18 placed in the inlet opening and the housing 10 simply hand-held. In this way, the tool of the present invention makes the procedure for refilling the engine with oil very easy and convenient without resulting in any spilled oil.

Figure 2:
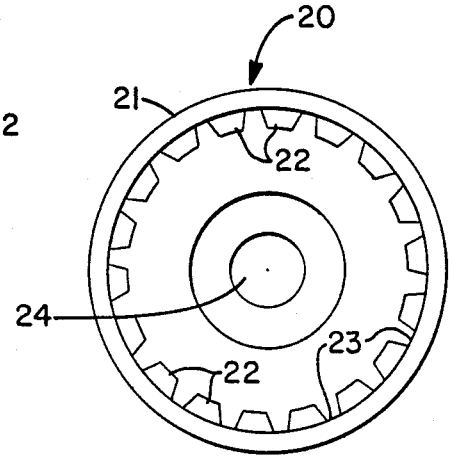
FIG. 2 is a top plan view of the tool of the present invention.

Turning now to FIG. 2, there is shown a top view of the tool of the present invention generally designated by reference numeral 20. As is more clearly seen, the tool comprises an upper portion 21 forming an open top end having a diameter greater than that of the canister type filter with which the tool is to be used. The projections 22 on the inside of the housing are seen to form a smaller diameter surface for frictionally engaging the filter canister. The projections 22 are made somewhat resilient and have rounded outer portions so that when the canister type filter is inserted they will engage and be flattened by the filter so as to frictionally grip a significant portion of the surface area of the filter. The resiliency of projections 22 accommodates some variance in the size of the canister type filter, and also insures proper operation of the tool. Also in this figure, the channels 23 between the projections 22, allow the escaped oil to travel around the projections and down to outlet opening 24.

Figure 3:
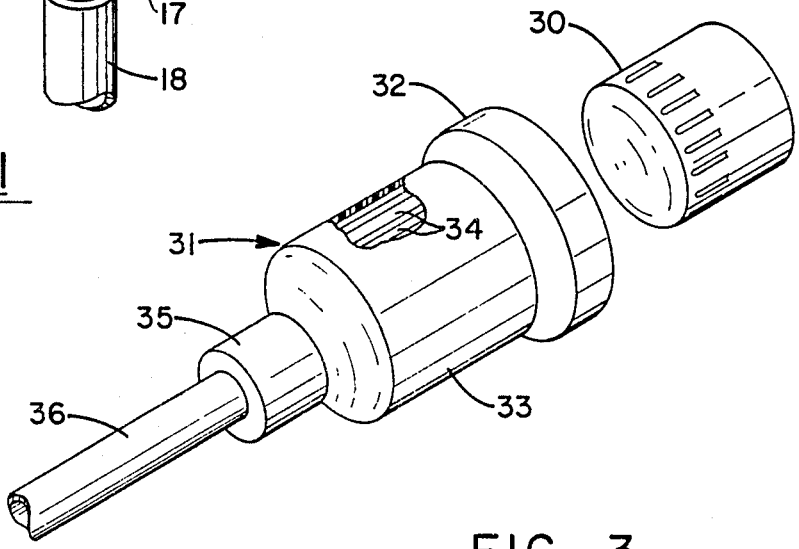
FIG. 3 is a perspective view of a conventional engine canister type oil filter and the tool of the present invention prior to engagement of the tool with the canister filter.

A conventional oil filter canister, designated generally by the reference numeral 30, for use in an internal combustion engine is shown in FIG. 3. The canister 30 is typical of that used in the automobile industry as well as on tractors and other vehicles. The tool of the present invention 31 is shown in relation to canister 30, and for placement therearound. As seen, the upper portion 32 has a greater diameter and will assuredly retain any escaped fluid from the filter. The reduced diameter main body portion 33 contains projections 34 inside thereof which will frictionally engage the filter 30 upon insertion. The outlet portion 35, as shown is adapted to place plastic tubing 36 thereon to remove the oil from the tool 31.

Figure 4:
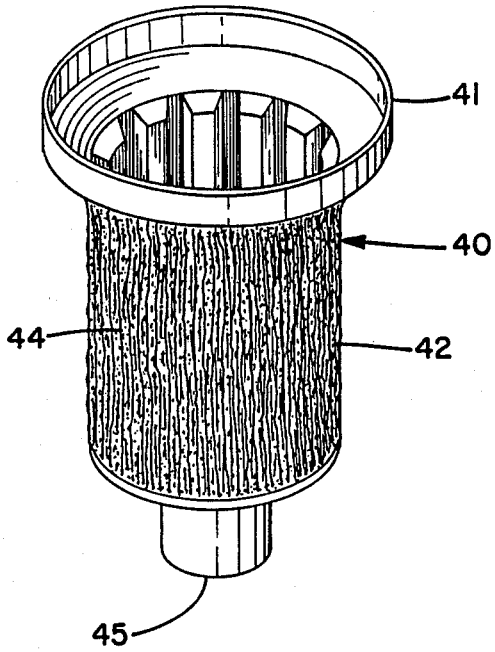
FIG. 4 is a perspective view of an alternate embodiment of the tool of the present invention.

An alternate embodiment of the invention is shown in FIG. 4, which is of basically the same construction as previously described except that a roughened surface 41 is provided on the main body portion of the tool housing. By this construction, the mechanic may easily grasp and turn the tool to facilitate removal of the filter canister. It is seen by use of the tool that the filter may be removed conveniently, cleanly, and quickly without waiting for the oil to drain from the filter.

Figure 5:
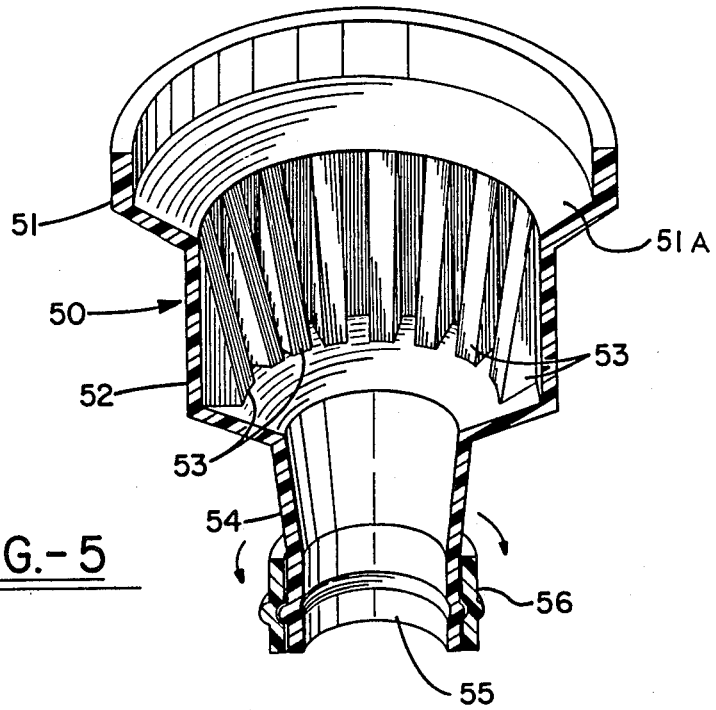
FIG. 5 is a perspective cutaway view taken through the center of an alternate embodiment of the tool of the present invention.

Reference is now made to FIG. 5 of the drawings, wherein a modified design of the tool of the present invention is shown by reference numeral 50. In this form of the invention, the tool includes the upper portion of greater diameter 51, along with reduced diameter main body portion 52 having projections 53 therein. An angled portion **51*a* extends inwardly from the upper portion 51 to the reduced diameter main body portion 52 to facilitate flow of fluid into the tool housing during removal of a oil filter or during use of the tool to refill the engine with oil. The projections 53 are seen to be wedge shaped, and tapering from near the outlet portion 55 to the open top end of the tool. In this way, the projections 53 will frictionally engage various sized filter canisters to be removed. The reservoir portion 54 of the tool is also shown to be tapered to provide better flow of any liquid in the housing towards the outlet portion 55. At the outlet portion 55, there is provided an adaptor 56 for engagement with a length of plastic tubing. The adaptor 56 is rotatably secured to the outlet portion 55** so that upon engagement with the tubing the tool can be rotated relative to the tubing. The advantages of this construction are readily evident, as removal of the filter canister will occur without worry of the plastic tubing or its movements.

From the foregoing, it may be seen that the objects of the invention are achieved by the illustrated and described embodiments, which provide a novel tool for removing canister type oil filters. Such removal may be obtained without leakage or spillage of the oil in a quick and convenient manner. Accordingly, it is intended to embrace all such alternatives, modifications, and variations which fall within the spirit and scope of the appended claims.

What is claimed is:

1. A tool for removal of canister type filters from an engine, and for re-filling the engine with a fluid; comprising:

a housing having a main body portion with a diameter so as to accommodate said filter;

said housing having an upper open end for insertion of said filter;

said housing including a greater diameter portion at said upper open end and an inwardly extending surface coupling said greater diameter portion with said main body portion;

said main body portion having projections on the inside thereof, forming a smaller diameter surface which frictionally engages said filter;

said housing having an outlet portion of reduced diameter and adapted to engage a plastic tubing for draining any fluids entering said housing.

2. A tool as in claim 1, wherein;

said projections are tapered from said outlet portion of said housing towards said open upper end to facilitate frictional engagement with different sized filters.

3. A tool as in claim 1, further comprising said housing having a roughened surface on the outside thereof for easy grasping and to facilitate unscrewing said filter.

4. A tool as in claim 1, wherein:

said outlet portion has an adapter for engaging said plastic tubing, rotatably secured thereto thereby making said housing rotatable relative to said plastic tubing.

5. A tool as in claim 1, further comprising;

a reservoir positioned between said projections and said outlet portion to accommodate a significant amount of fluid therein.

6. A tool as in claim 1, wherein;

said projections are provided with channels therebetween for oil to drain around said filter.

7. A tool as in claim 1, wherein;

said projections are formed of a resilient material so as to facilitate the frictional engagement with said filter.

8. A tool as in claim 7, wherein;

said projections are formed rounded so as to be resiliently deformed upon insertion of said filter;

said resilient deformation enabling engagement of a significant portion of the surface area of said filter.

9. A tool as in claim 1, wherein;

said upper open end has a diameter greater than said main body portion to assuredly retain fluids draining from said filter or said engine.

10. A tool as in claim 5, wherein;

said reservoir has tapered sides to facilitate the flow of any fluids entering said housing to said outlet portion.

11. A tool for removing canister type filters without leakage and for adding fluid to an engine, comprising;

a housing having a circular cross-section with a main body portion having dimensions to accommodate said canister or an amount of fluid to be added and an upper open end having a greater diameter than said main body portion to receive said canister or a fluid to be added;

said upper open end being coupled to said main body portion by an inwardly extending surface;

said housing have resilient projections on the inside thereof to frictionally engage said canister;

said housing having a reservoir to accommodate an amount of fluid therein;

said housing having a lower outlet portion; wherein any leakage from said canister or a fluid to be added is directed by means of said reservoir to said outlet portion to drain said reservoir and housing thereby enabling the function as a funnel-type tool for adding fluid to an engine.

* * * * *